US011839316B2

(12) United States Patent
Fenerty

(10) Patent No.: US 11,839,316 B2
(45) Date of Patent: Dec. 12, 2023

(54) CELLULOSIC DISPLAY STRUCTURES AND ASSOCIATED CELLULOSIC DISPLAY SYSTEMS

(71) Applicant: WestRock Shared Services, LLC, Atlanta, GA (US)

(72) Inventor: Bryan M. Fenerty, Mount Laurel, NJ (US)

(73) Assignee: WestRock Shared Services, LLC, Atlanta, GA (US)

( * ) Notice: Subject to any disclaimer, the term of this patent is extended or adjusted under 35 U.S.C. 154(b) by 0 days.

(21) Appl. No.: 17/665,527

(22) Filed: Feb. 5, 2022

(65) Prior Publication Data

US 2022/0248875 A1 Aug. 11, 2022

Related U.S. Application Data

(60) Provisional application No. 63/146,173, filed on Feb. 5, 2021.

(51) Int. Cl.
*A47F 5/11* (2006.01)
*A47F 5/08* (2006.01)

(52) U.S. Cl.
CPC ..... *A47F 5/112* (2013.01); *A47F 5/0815* (2013.01); *A47F 5/0869* (2013.01)

(58) Field of Classification Search
CPC ..... A47F 5/112; A47F 5/0815; A47F 5/0869; A47F 5/11; A47B 47/06; A47B 55/06; A47B 96/068; A47B 96/061
USPC ..... 211/13.1, 41.7, 85.4, 73, 104, 90.01, 211/90.02; 248/247, 248, 300, 301, 339, 248/690
See application file for complete search history.

(56) References Cited

U.S. PATENT DOCUMENTS 597,230 A * 1/1898 Weston ..... A47F 5/0823 402/14
1,071,041 A * 8/1913 Trager ..... B60T 17/046 248/300
1,113,538 A * 10/1914 Braucher et al. ..... A47F 5/112 368/41
1,254,639 A * 1/1918 Lang ..... A47F 5/112 248/152
1,415,224 A * 5/1922 Dickmeyer ..... A47F 5/112 248/459

(Continued)

*Primary Examiner* — Jennifer E. Novosad
(74) *Attorney, Agent, or Firm* — Neil G. Cohen; Brian J. Goldberg

(57) ABSTRACT

A cellulosic display structure includes a plurality of sidewall panels having a central panel. The central panel has a first central surface and an opposing second central surface. The plurality of sidewall panels further includes a first sidewall panel having at least one hook feature. A cellulosic display system includes a cellulosic display. The cellulosic display has a plurality of slots. The cellulosic display system further includes at least one cellulosic display structure. The at least one cellulosic display structure has a plurality of sidewall panels. The plurality of sidewall panels includes a central panel. The central panel has a first central surface and an opposing second central surface. The plurality of sidewall panels further includes a first sidewall panel. The first sidewall panel includes at least one hook feature. The cellulosic display structure is engageable with at least one slot of the plurality of slots of the cellulosic display.

18 Claims, 9 Drawing Sheets

(56) References Cited

U.S. PATENT DOCUMENTS 1,470,159 A * 10/1923 Gibson ..... A47F 5/112 248/459
1,495,943 A * 5/1924 Wiley ..... A47F 5/112 248/248
1,577,001 A * 3/1926 Snider ..... A47F 5/112 248/459
1,579,099 A * 3/1926 Fernstrom ..... A47F 5/112 248/174
1,586,637 A * 6/1926 Myers ..... B65D 5/504 206/482
1,625,436 A * 4/1927 Stranders ..... A47F 5/112 248/174
1,683,007 A * 9/1928 Ziemmerman ..... A47F 5/112 40/617
1,713,961 A * 5/1929 Goodyear ..... A47F 5/112 229/932
1,821,313 A * 9/1931 Marsh ..... A47F 5/112 211/72
1,852,262 A * 4/1932 Pleiss ..... A47G 29/08 248/300
1,933,374 A * 10/1933 Haggard ..... A47F 5/08 211/90.01
2,049,638 A * 8/1936 Bennett ..... G09F 1/06 211/90.01
2,298,744 A * 10/1942 Liermann ..... A47G 29/08 248/300
2,430,302 A * 11/1947 Ringler ..... B65D 71/0011 206/427
2,510,711 A * 6/1950 Morsch ..... D06F 79/00 248/301
2,564,259 A * 8/1951 Hoglund ..... A47B 96/022 108/42
2,565,440 A * 8/1951 Soref ..... A47F 5/0876 211/96
2,632,269 A * 3/1953 Sanders ..... G09F 21/04 40/594
2,726,835 A * 12/1955 Hummel ..... A47F 5/112 248/459
2,796,213 A * 6/1957 Shanahan ..... B65D 5/48034 229/120.16
2,888,148 A * 5/1959 Meyers ..... A47F 5/0068 248/300
2,897,977 A * 8/1959 Buttery ..... A47F 5/112 108/100
3,013,668 A * 12/1961 Mennen ..... A47F 5/112 211/195
3,101,166 A * 8/1963 Van Antwerpen ..... B65D 5/504 206/588
3,193,108 A * 7/1965 Johnson ..... A47F 5/0068 229/164
3,208,583 A * 9/1965 Kamps ..... A47F 5/112 206/557
3,282,437 A * 11/1966 Hansen ..... A47F 7/0064 211/41.7
3,462,020 A * 8/1969 Hall ..... A47F 5/112 206/419
3,756,385 A * 9/1973 Steinbock ..... B65D 5/5021 206/526
3,999,662 A * 12/1976 Barnhardt ..... A47F 5/112 229/120.36
D245,290 S * 8/1977 Kingsford ..... D20/10
4,201,291 A * 5/1980 Davidson ..... B65D 5/4208 229/242
4,222,187 A * 9/1980 Huck ..... G09F 1/04 40/594
4,603,825 A * 8/1986 Kotliar ..... A47G 19/30 206/525
4,687,094 A * 8/1987 Allsop ..... B65D 5/52 206/774
4,723,492 A * 2/1988 Salvatini ..... A47F 5/112 108/42
4,733,782 A * 3/1988 Spezial ..... A47F 5/0876 248/225.11
4,746,010 A * 5/1988 Fournier ..... B65D 81/36 206/746
4,905,947 A * 3/1990 Henne ..... A47F 5/112 248/152
D328,398 S * 8/1992 Benedetto ..... 211/85.2
5,367,127 A * 11/1994 Dormon ..... H02G 1/00 206/443
5,465,851 A * 11/1995 Smith ..... A47F 5/11 108/162
D367,677 S * 3/1996 Noreika ..... D20/40
5,620,104 A * 4/1997 Maglione ..... A47F 5/0815 211/189
5,762,207 A * 6/1998 Maglione ..... A47F 5/112 211/59.1
6,027,081 A * 2/2000 Rosenberg ..... A47K 1/09 248/300
6,119,875 A * 9/2000 Smith ..... A47F 5/112 211/195
D470,360 S * 2/2003 Stanco ..... 211/85.4
6,557,711 B2 * 5/2003 Grueneberg ..... A47F 5/112 211/119.003
6,675,978 B2 * 1/2004 Shea ..... A47F 5/0823 211/181.1
D493,309 S * 7/2004 Moss ..... D6/705
6,793,070 B2 * 9/2004 Dye ..... A47F 5/112 229/164
6,929,133 B1 * 8/2005 Knapp, III ..... A47F 5/0807 211/132.1
7,823,851 B2 * 11/2010 Chen ..... F16B 45/00 248/301
8,286,806 B2 * 10/2012 Norris ..... A61G 12/00 211/26.1
9,004,433 B2 * 4/2015 Krieger ..... B60N 3/102 224/276
9,125,503 B2 * 9/2015 Hawkins ..... A47F 5/0815
9,867,483 B2 * 1/2018 Shea ..... G09F 23/06
10,314,413 B1 * 6/2019 Smith ..... A47F 5/112
11,337,531 B2 * 5/2022 Zhang ..... A47F 5/11
2002/0124941 A1 * 9/2002 Valiulis ..... G09F 3/204 156/289
2002/0166828 A1 * 11/2002 Fulbright ..... A47B 96/028 211/90.02
2006/0118502 A1 * 6/2006 Polvere ..... A47F 5/112 211/187
2013/0168287 A1 * 7/2013 James ..... B65D 5/5021 206/763
2015/0250335 A1 * 9/2015 Waksul ..... A47F 10/06 211/85.4
2016/0143439 A1 * 5/2016 Jablow ..... A47B 47/0058 211/90.01
2017/0249874 A1 * 8/2017 López Fernández ..... A47F 5/11
2021/0251400 A1 * 8/2021 Coan ..... B65D 25/04
2021/0259437 A1 * 8/2021 Tasch ..... B65D 75/56
2022/0248875 A1 * 8/2022 Fenerty ..... A47F 5/0869

* cited by examiner

CELLULOSIC DISPLAY STRUCTURES AND ASSOCIATED CELLULOSIC DISPLAY SYSTEMS

CROSS-REFERENCE TO RELATED APPLICATION DATA

This application claims the benefit of priority to U.S. Provisional Patent Application No. 63/146,173 filed Feb. 5, 2021, the entire contents of which is incorporated herein by reference.

FIELD

The present disclosure relates generally to display structures and, more particularly, to cellulosic display structures and associated cellulosic display systems for displaying retail products.

BACKGROUND

In the field of display packaging and structures, specifically with retail and point-of-purchase displays, it is common to hang merchandise from a hook or other hanging feature. Many times, the point-of-purchase display structures are used temporarily to feature a new product and, thus, are disposable.

While the outer structure of a point-of-purchase display is typically formed from a paperboard material, any hooks or rods used as a means of hanging are typically comprised of a plastic material, such as glass filled nylon. Plastic is becoming less desirable to include in disposable displays due to its wasteful nature, as plastic hooks, such as those containing glass filled nylon, are difficult to recycle. Further, it is laborious to disassemble a point-of-purchase display structure to separate the readily recyclable components from the difficult to recycle components. One drawback to using recyclable materials is that they are less rigid than recyclable materials and thus may not be as durable.

Accordingly, those skilled in the art continue with research and development efforts in the field of display packaging and structures.

SUMMARY

Disclosed are various cellulosic display structures.

In one example, a disclosed cellulosic display structure includes a plurality of sidewall panels. The plurality of sidewall panels includes a central panel. The central panel has a first central surface and an opposing second central surface. The plurality of sidewall panels further includes a first sidewall panel. The first sidewall panel includes at least one hook feature.

In another example, a disclosed cellulosic display structure includes a plurality of sidewall panels. The plurality of sidewall panels includes a central panel. The central panel has a first central surface and an opposing second central surface. The plurality of sidewall panels further includes a first sidewall panel. The first sidewall panel includes at least one hook feature. The plurality of sidewall panels further includes a second sidewall panel. The second sidewall panel includes at least one hook feature. The disclosed cellulosic display structure further includes a first transition panel positioned between the central panel and the first sidewall panel, wherein the first transition panel is defined by a first central fold line and a first transition fold line, and wherein the first transition panel is movable between a first configuration and a second configuration. The disclosed cellulosic display structure further includes a second transition panel positioned between the central panel and the second sidewall panel, wherein the second transition panel is defined by a second central fold line and a second transition fold line, and wherein the second transition panel is movable between a first configuration and a second configuration.

In yet another example, a disclosed cellulosic display structure includes a plurality of sidewall panels, the plurality of sidewall panels including a first sidewall panel, the first sidewall panel including at least one hook feature, and a second sidewall panel, the second sidewall panel including at least one hook feature.

Also disclosed are various cellulosic display systems.

In one example, a disclosed cellulosic display system includes a cellulosic display. The cellulosic display has a plurality of slots. The cellulosic display system further includes at least one cellulosic display structure. The at least one cellulosic display structure has a plurality of sidewall panels. The plurality of sidewall panels includes a central panel. The central panel has a first central surface and an opposing second central surface. The plurality of sidewall panels further includes a first sidewall panel. The first sidewall panel includes at least one hook feature. The cellulosic display structure is engageable with at least one slot of the plurality of slots of the cellulosic display.

In another example, a disclosed cellulosic display system includes a cellulosic display. The cellulosic display has a plurality of slots. The cellulosic display system further includes at least one cellulosic display structure. The at least one cellulosic display structure has a plurality of sidewall panels. The plurality of sidewall panels includes a first sidewall panel, the first sidewall panel including at least one hook feature, and a second sidewall panel, the second sidewall panel including at least one hook feature.

Other examples of the disclosed cellulosic display structures and cellulosic display systems will become apparent from the following detailed description, the accompanying drawings, and the appended claims.

DETAILED DESCRIPTION

Figure 1:
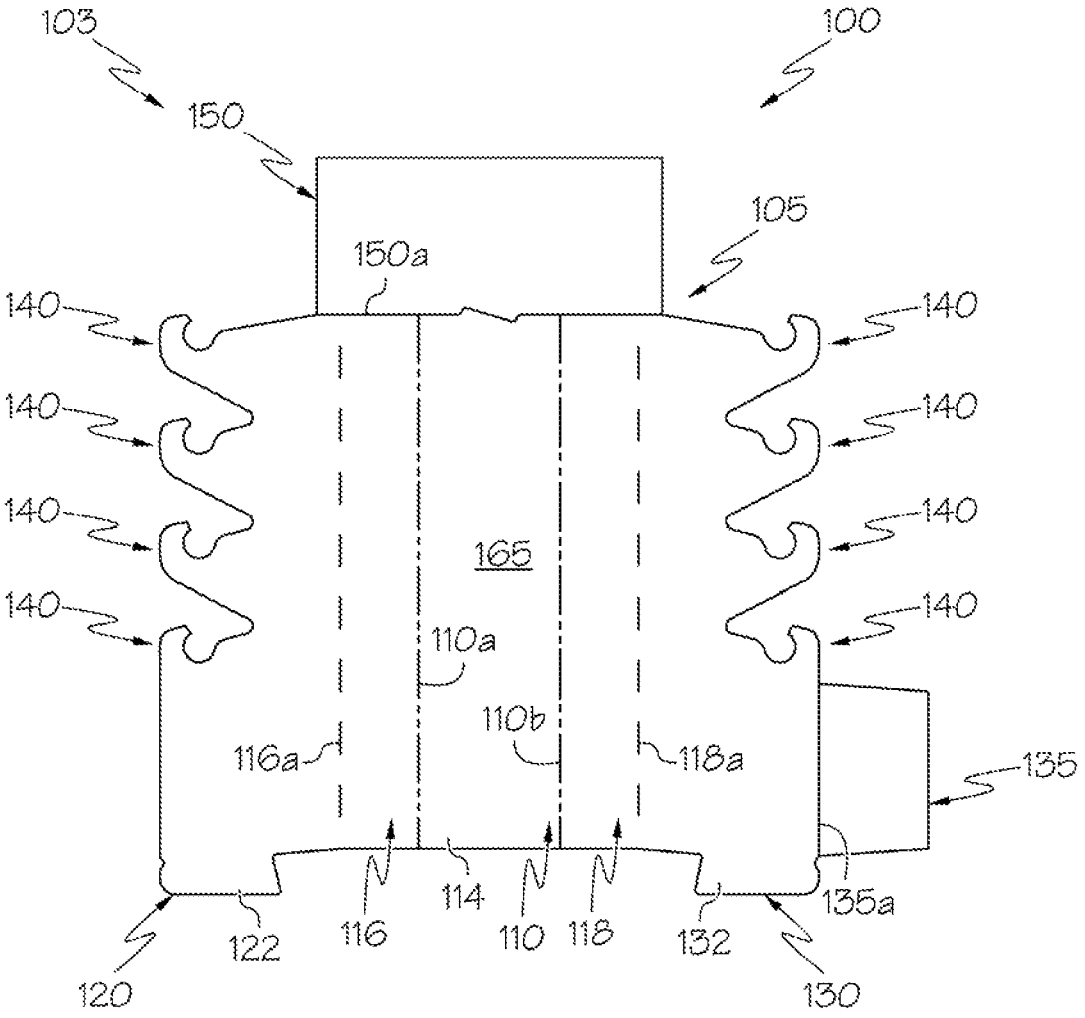
FIG. 1 is a top plan view of a cellulosic blank that may be assembled into the disclosed cellulosic display structure.

The following detailed description refers to the accompanying drawings, which illustrate specific examples of the disclosed cellulosic display structures and disclosed cellulosic display systems. It will be understood that the disclosed examples are merely exemplary embodiments of the way in which certain aspects of the invention can be implemented and do not represent an exhaustive list of all of the ways the invention may be embodied. Other examples having different structures and operations do not depart from the scope of the present disclosure. Like reference numerals may refer to the same feature, element, or component in the different drawings. The figures are not necessarily to scale and some features may be exaggerated or minimized to show details of particular components. Throughout the present disclosure, any one of a plurality of items may be referred to individually as the item and a plurality of items may be referred to collectively as the items. Moreover, as used herein, a feature, element, component, or step preceded with the word "a" or "an" should be understood as not excluding a plurality of features, elements, components, or steps, unless such exclusion is explicitly recited.

Illustrative, non-exhaustive examples, which may be, but are not necessarily, claimed, of the subject matter according to the present disclosure are provided below. Reference herein to "example" means that one or more feature, structure, element, component, characteristic, and/or operational step described in connection with the example is included in at least one aspect, embodiment, and/or implementation of the subject matter according to the present disclosure. Thus, the phrases "an example," "another example," "one or more examples," and similar language throughout the present disclosure may, but do not necessarily, refer to the same example. Further, the subject matter characterizing any one example may, but does not necessarily, include the subject matter characterizing any other example. Moreover, the subject matter characterizing any one example may be, but is not necessarily, combined with the subject matter characterizing any other example.

The disclosed cellulosic display structure 100 offers a sustainable, recyclable, disposable hanging product useful for retail and merchandise displays. In one example, the cellulosic display structure 100 includes a plurality of sidewall panels 105 defined by a plurality of fold lines 115, wherein at least one sidewall panel of the plurality of sidewall panels 105 includes at least one hook feature 140. In another example, at least one sidewall panel of the plurality of sidewall panels 105 includes more than one hook feature 140 that allows peggable product to hang in individual locations.

The disclosed cellulosic display structure 100 is desirable for retailer point-of-purchase displays that may be used temporarily or for longer periods of time. In one example, the cellulosic display structure 100 is configured to removably or permanently engage with a cellulosic display 175 such that the cellulosic display 175 does not need to be disassembled prior to recycling once the cellulosic display 175 is no longer needed.

Figure 2:
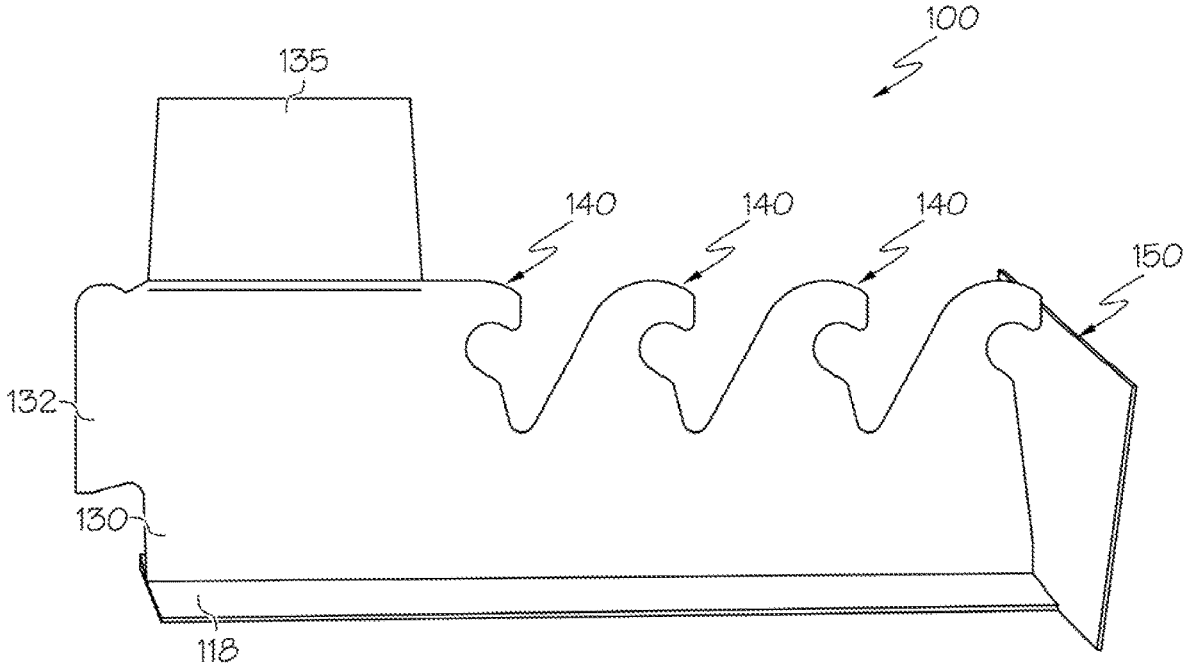
FIG. 2 is an inverted, side perspective view of a cellulosic display structure formed from the cellulosic blank of FIG. 1.
Figure 3:
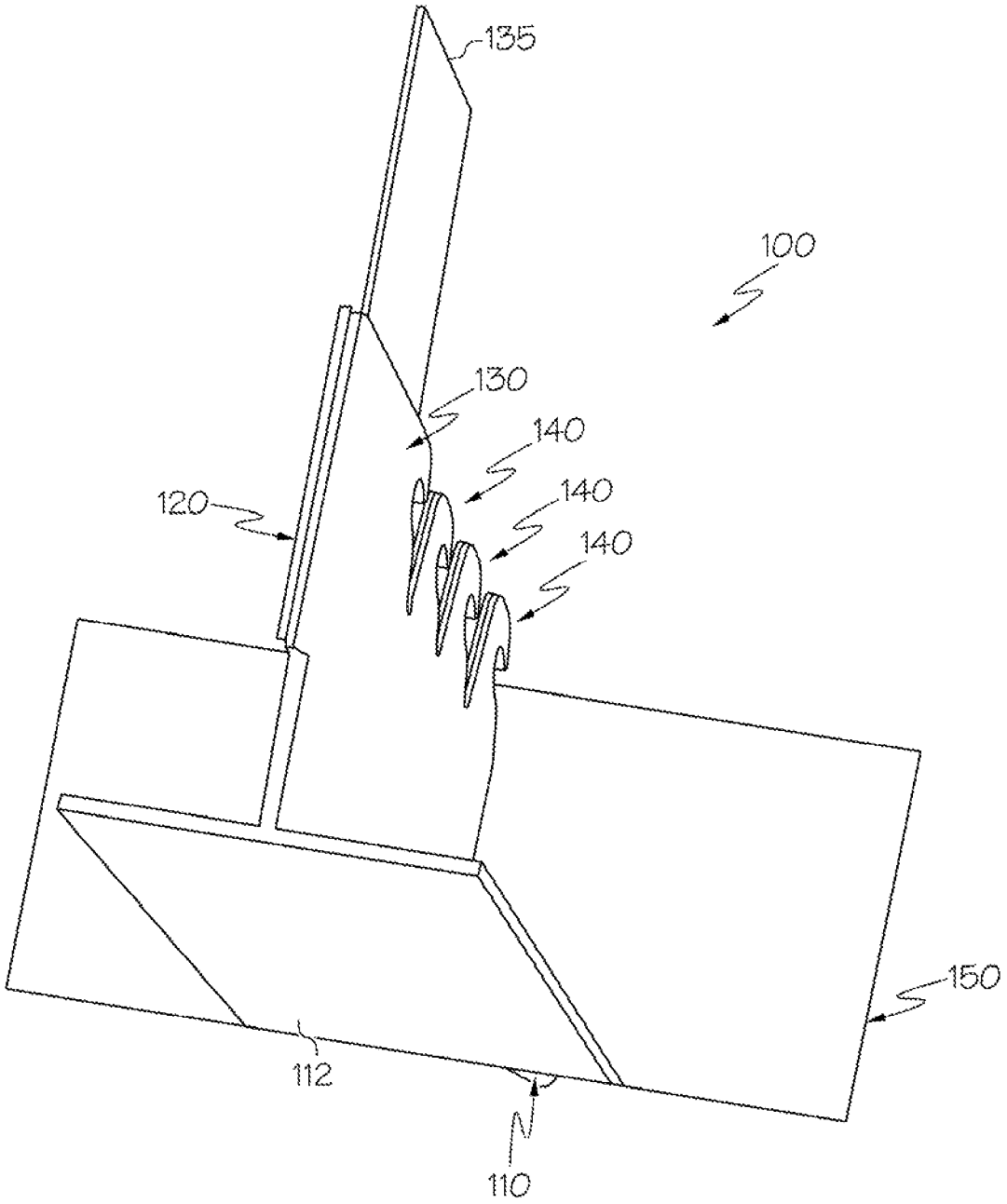
FIG. 3 is an inverted, rear perspective view of a cellulosic display structure formed from the cellulosic blank of FIG. 1.

Referring to FIGS. 1-3, illustrated is one example of the disclosed cellulosic display structure 100 and a blank 103 (FIG. 1) that may be assembled into the disclosed cellulosic display structure 100. The cellulosic display structure 100 includes a plurality of sidewall panels 105 including a central panel 110 having a first central surface 112, see FIG. 3, and a second central surface 114 opposed from the first central surface 112. The central panel 110 is defined by a first central fold line 110*a* and a second central fold line 110*b* of the plurality of fold lines 115. In one example, the central panel 110 serves as an upper rail from which other features may hang.

Referring to FIG. 1, in one or more examples, the cellulosic display structure 100 shown in FIGS. 2 and 3 may be assembled from a blank 103. Assembly may be either manual or performed using a machine.

The blank 103 is assemblable into the cellulosic display structure 100 and includes a plurality of sidewall panels 105 that are connected along a plurality of fold lines 115. Any one of the fold lines, as well as any other fold lines and/or hinge lines described herein, may include any suitable predefined or preformed line of weakening and/or line of separation known to those skilled in the art and guided by the teachings herein provided, such as a crease, a score, a perforation, or the like. Generally, the plurality of fold lines 115 provide a means to transform the blank 103 into a plurality of separate but integral sidewall panels and tabs. For example, one or more of the plurality of sidewall panels 105 are hingedly moved (e.g., rotated or folded) about an adjacent fold line from a flat configuration, or first configuration, to a constructed configuration, or second configuration, such that the plurality of sidewall panels 105 form the cellulosic display structure 100.

Referring to FIG. 1, in one example, the central panel 110 includes an adhesive 165. The adhesive 165 can be a glue, tape, paste, or any other suitable means for binding the central panel 110 to another portion of the cellulosic display structure 100. In one example, the adhesive 165 is applied to the cellulosic display structure 100 automatically during fabrication. In another example, the adhesive 165 is applied manually after a blank 103 of the cellulosic display structure 100 is manufactured.

Referring to FIG. 1, in one example, the cellulosic display structure 100 includes a first sidewall panel 120 and a second sidewall panel 130 defined by a first transition fold line 116*a* and a second transition fold line 118*a* of the plurality of fold lines 115. The first sidewall panel 120 and the second sidewall panel 130 are located on opposing sides of the central panel 110 and have substantially the same geometry such that they mirror each other on either side of the central panel 110.

Referring to FIGS. 1-3, in one example, at least one of the first sidewall panel 120 and the second sidewall panel 130 includes at least one hook feature 140. In another example, both the first sidewall panel 120 and the second sidewall panel 130 include at least one hook feature 140. In another example, the at least one hook feature on the first sidewall panel 120 and the second sidewall panel 130 are configured to align when the cellulosic display structure 100 is in the second configuration such that they abut each other to form a single hook feature 140. In another example, the first sidewall panel 120 includes more than one (e.g., two or more) hook feature 140 and the second sidewall panel 130 includes more than one (e.g., two or more) hook feature 140.

Referring to FIG. 1, the first sidewall panel 120 includes a first engagement tab 122. The first engagement tab 122 may be integral with the cellulosic display structure 100 and may be configured to engage the cellulosic display structure 100 with another structure. In one example, the first engagement tab 122 is configured to align and engage with a cellulosic display 175, see FIGS. 8 and 9.

Referring to FIG. 1, in one or more examples, the cellulosic display structure 100 includes a first transition panel 116 positioned between the central panel 110 and the first sidewall panel 120. The first transition panel 116 is defined by a first central fold line 110*a* and a first transition fold line 116*a* of the plurality of fold lines 115.

In one example, the first transition panel 116 of the cellulosic display structure 100 is movable between a first configuration and a second configuration. The first transition panel 116 is substantially aligned with the central panel 110 and the first sidewall panel 120 when the cellulosic display structure 100 is in the first configuration. In another example, the first transition panel 116 overlaps with a portion of the central panel 110 when the cellulosic display structure 100 is in the second configuration. In one example, the first transition panel 116 overlaps with a portion of the central panel 110 containing the adhesive 165 such that the adhesive 165 holds the first transition panel 116 against the second central surface 114 of the central panel 110.

Referring to FIGS. 2 and 3, in one or more examples, the first sidewall panel 120 is generally perpendicular to the central panel 110 and the first transition panel 116 when the cellulosic display structure 100 is in the second configuration such that the first central panel 110, the first transition panel 116, and the first sidewall panel 120 generally form a "T" shape.

Referring to FIG. 1, the second sidewall panel 130 includes a second engagement tab 132. The second engagement tab 132 is integral with the cellulosic display structure 100 and is configured to engage the cellulosic display structure 100 with another structure. In one example, the second engagement tab 132 is configured to align and engage with a cellulosic display 175, see FIGS. 6 and 7.

Referring to FIG. 1, in one or more examples, the cellulosic display structure 100 includes a second transition panel 118 positioned between the central panel 110 and the second sidewall panel 130. The second transition panel 118 is defined by a second central fold line 110*b* and a second transition fold line 118*a* of the plurality of fold lines 115.

In one example, the second transition panel 118 of the cellulosic display structure 100 is movable between a first configuration and a second configuration. The second transition panel 118 is substantially aligned with the central panel 110 and the second sidewall panel 130 when the cellulosic display structure 100 is in the first configuration. In another example, the second transition panel 118 overlaps with a portion of the central panel 110 when the cellulosic display structure 100 is in the second configuration. In one example, the second transition panel 118 overlaps with a portion of the central panel 110 containing the adhesive 165 such that the adhesive 165 holds the second transition panel 118 against the second central surface 114 of the central panel 110.

Referring to FIGS. 2 and 3, in one or more examples, the second sidewall panel 130 is substantially perpendicular to the central panel 110 and the second transition panel 118 when the cellulosic display structure 100 is in the second configuration. Therefore, the central panel 110, the second transition panel 118, and the second sidewall panel 130 generally form a "T" shape. In one particular example, the first sidewall panel 120 and the second sidewall panel 130 abut each other when the cellulosic display structure 100 is in the second configuration.

Figure 6:
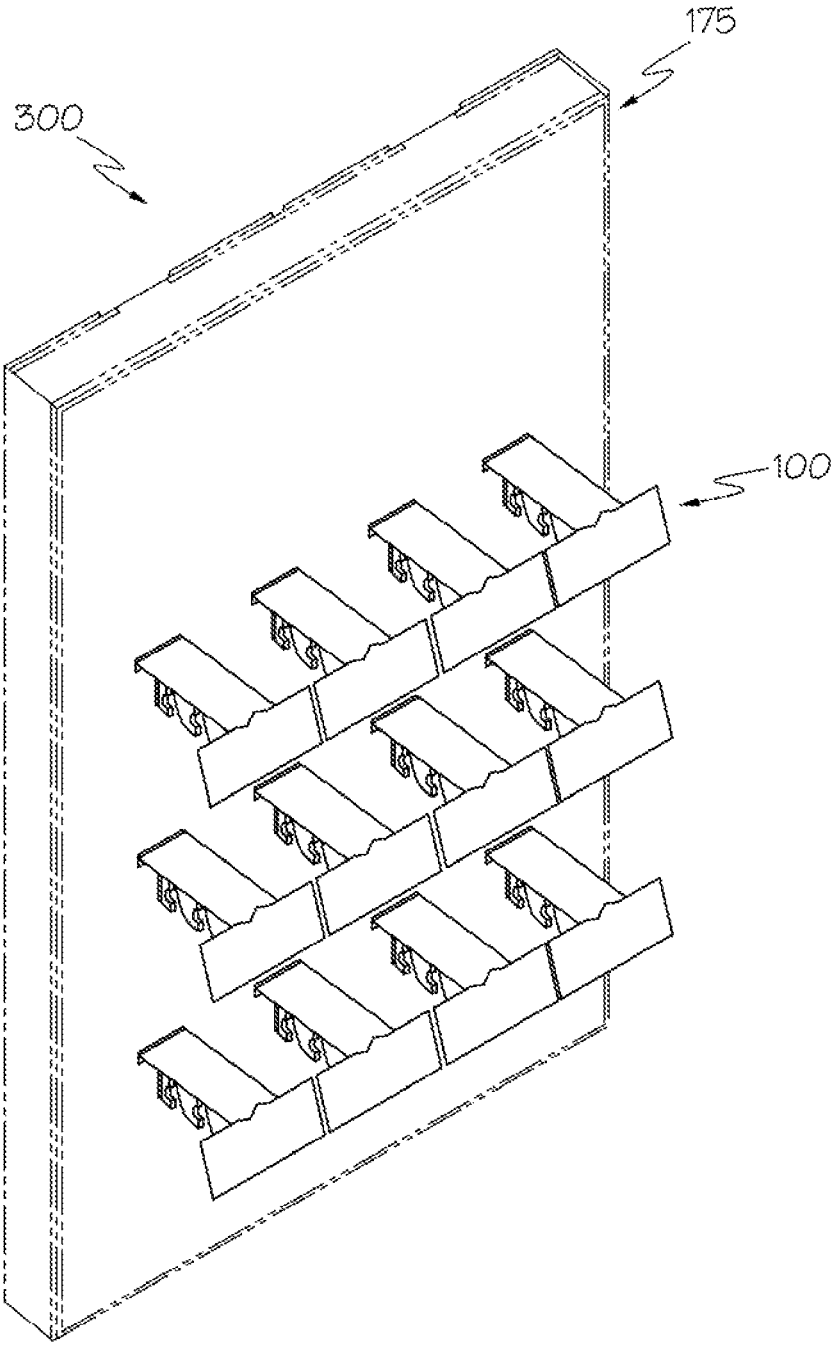
FIG. 6 is a side perspective view of a cellulosic display structure formed from the cellulosic blank of FIG. 5.
Figure 7:
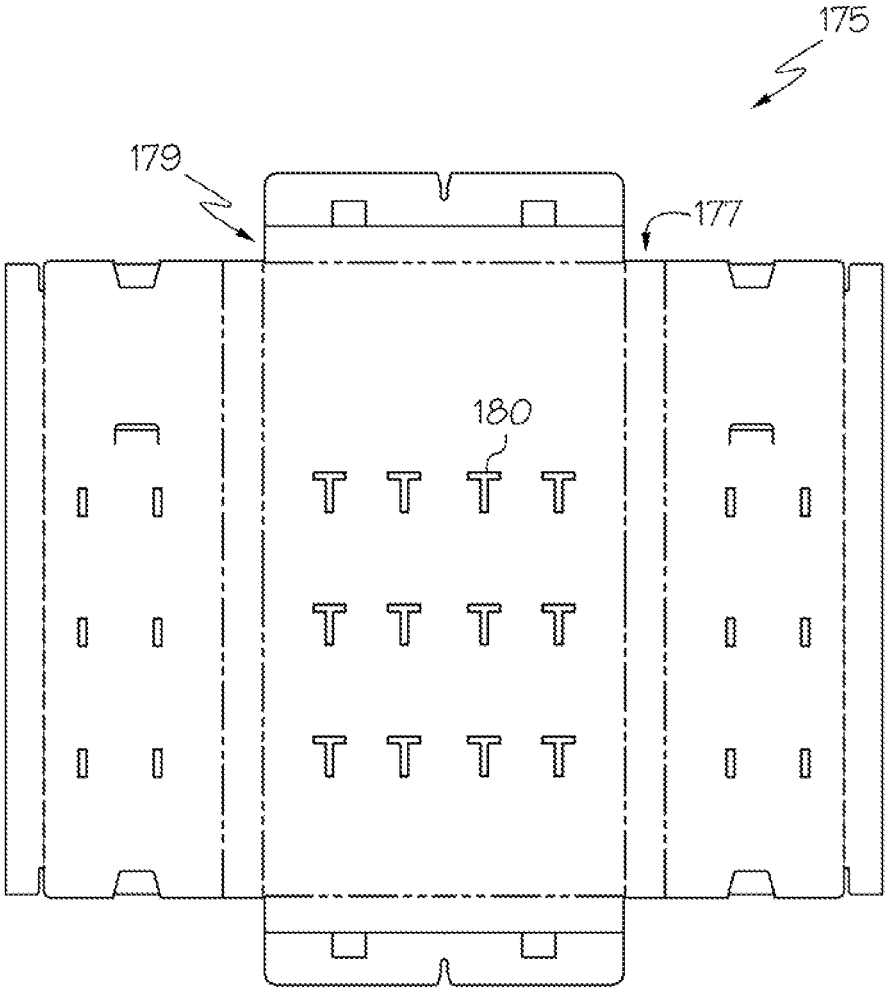
FIG. 7 is a top plan view of a blank that may be assembled into the cellulosic display system of FIG. 4.

Referring to FIGS. 1-3, in one or more examples, the second sidewall panel 130 includes a locking tab 135. Locking tab 135 is defined by a locking fold line 135*a* of the plurality of fold lines 115 of cellulosic display structure 100. Locking tab 135 is configured to fold along the locking fold line 135*a* and secure the cellulosic display structure 100 to another structure. In one example, the locking tab 135 is configured to secure the cellulosic display structure 100 in a cellulosic display 175, as shown in FIGS. 6 and 7.

Referring to FIGS. 1-3, in one or more examples, the cellulosic display structure 100 includes a display tab 150. The display tab 150 is movable along a display fold line 150*a* of the plurality of fold lines 115. The display tab 150 is configured to display indicia, such as for advertising or labeling purposes with respect to a product on display.

Figure 4:
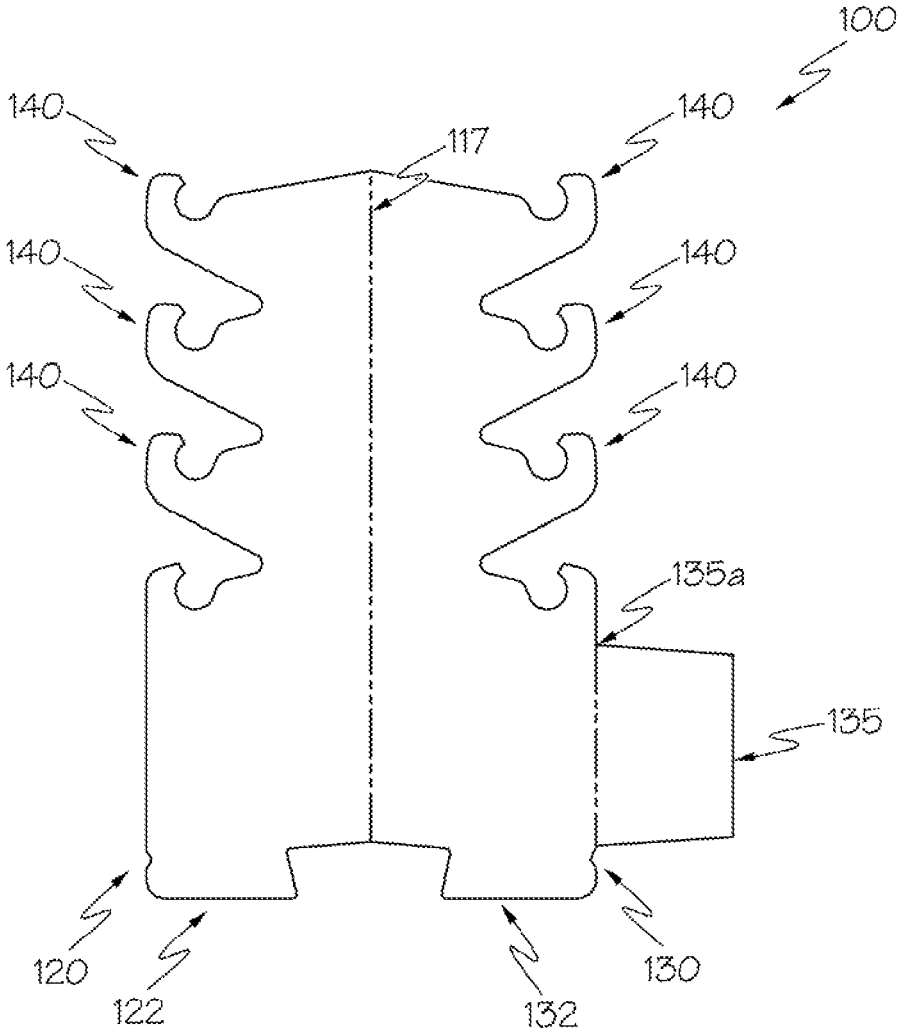
FIG. 4 is a front perspective view of a cellulosic display system including the cellulosic display structure of FIG. 2.
Figure 5:
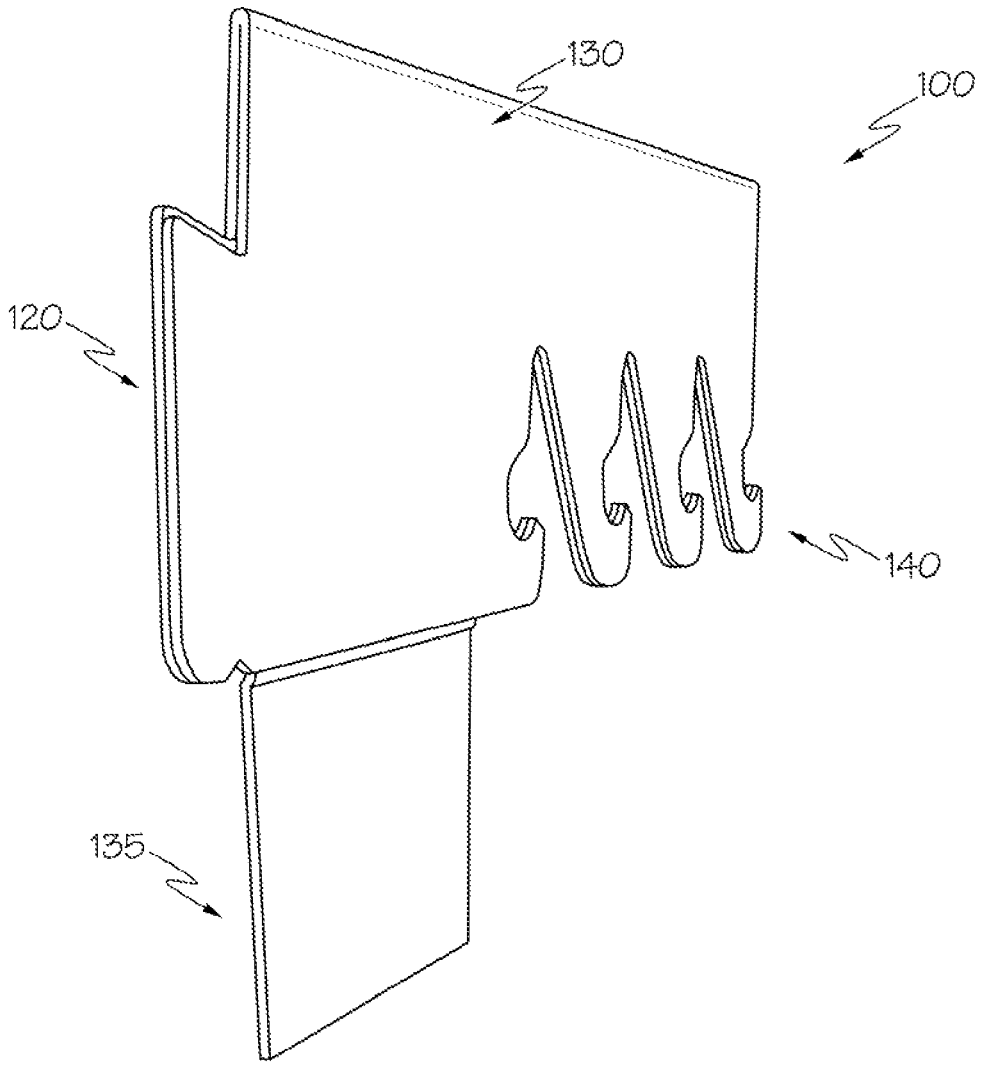
FIG. 5 is a top plan view of another cellulosic blank that may be assembled into the disclosed cellulosic display structure.

Referring to FIG. 4 and FIG. 5, in one or more examples, the cellulosic display structure 100 comprises a first sidewall panel 120 defined by a central fold line 117 of the plurality of fold lines 115. In one example, first sidewall panel 120 includes at least one hook feature 140. In another example, the first sidewall panel 120 includes more than one hook feature 140.

Referring to FIG. 4 and FIG. 5, in one or more examples, the first sidewall panel 120 includes a first engagement tab 122. The first engagement tab 122 may be integral with the cellulosic display structure 100 and may be configured to engage the cellulosic display structure 100 with another structure. In one example, the first engagement tab 122 is configured to align and engage with a cellulosic display 175, see FIGS. 8 and 9.

Referring to FIG. 4 and FIG. 5, in one or more examples, the cellulosic display structure 100 comprises a second sidewall panel 130. In one example, second sidewall panel 130 includes at least one hook feature 140. In another example, the second sidewall panel 130 includes more than one hook feature 140. In yet another example, the first sidewall panel 120 and the second sidewall panel 130 are substantially the same such that they substantially mirror each other along opposing sides of the central fold line 117.

Referring to FIG. 4 and FIG. 5, in one or more examples, the second sidewall panel 130 includes a second engagement tab 132. The second engagement tab 132 is integral with the cellulosic display structure 100 and is configured to engage the cellulosic display structure 100 with another structure. In one example, the second engagement tab 132 is configured to align and engage with a cellulosic display 175, see FIGS. 6 and 7.

Referring to FIG. 4 and FIG. 5, in one or more examples, the second sidewall panel 130 includes a locking tab 135. Locking tab 135 is defined by a locking fold line 135*a* of the plurality of fold lines 115 of cellulosic display structure 100. Locking tab 135 is configured to fold along the locking fold line 135*a* and secure the cellulosic display structure 100 to another structure. In one example, the locking tab 135 is configured to secure the cellulosic display structure 100 in a cellulosic display 175, as shown in FIGS. 6 and 7.

Referring to FIG. 4 and FIG. 5, in one or more examples, an adhesive 165 may be disposed between the first sidewall panel 120 and the second sidewall panel 130 to join the first sidewall panel 120 with the second sidewall panel 130 when in the second configuration. In one example, the adhesive 165 is disposed automatically during manufacturing. In another example, the adhesive 164 is disposed manually. In one example, the at least one hook feature 140 of the first sidewall panel 120 aligns with the at least one hook feature 140 of the second sidewall panel 130 when in the second configuration.

In one example, the cellulosic display structure 100 is die cut. In another example, the cellulosic display structure 100 is a single, monolithic structure such that it is cut from a single piece of material.

The blank 103 and, thus, the cellulosic display structure 100 are fabricated from a cellulosic material. In one or more examples, the blank 103 and, thus, the cellulosic display structure 100 are fabricated from a cardboard material. In other examples, the blank and, thus, the cellulosic display structure 100 may be fabricated using any suitable material and, therefore, is not limited to a specific type of material. For example, the blank 103 and, thus, the cellulosic display structure 100 may be fabricated using at least one of cardboard, fiberboard, paperboard, foamboard, corrugated paper, corrugated board and any other suitable cellulosic material known to those skilled in the art and guided by the teachings provided herein for providing lightweight, durable, and recyclable material properties. As used herein, a corrugated material generally includes two liner sheets and an inner fluted material that is sandwiched between and is coupled to the liner sheets.

Figure 9:
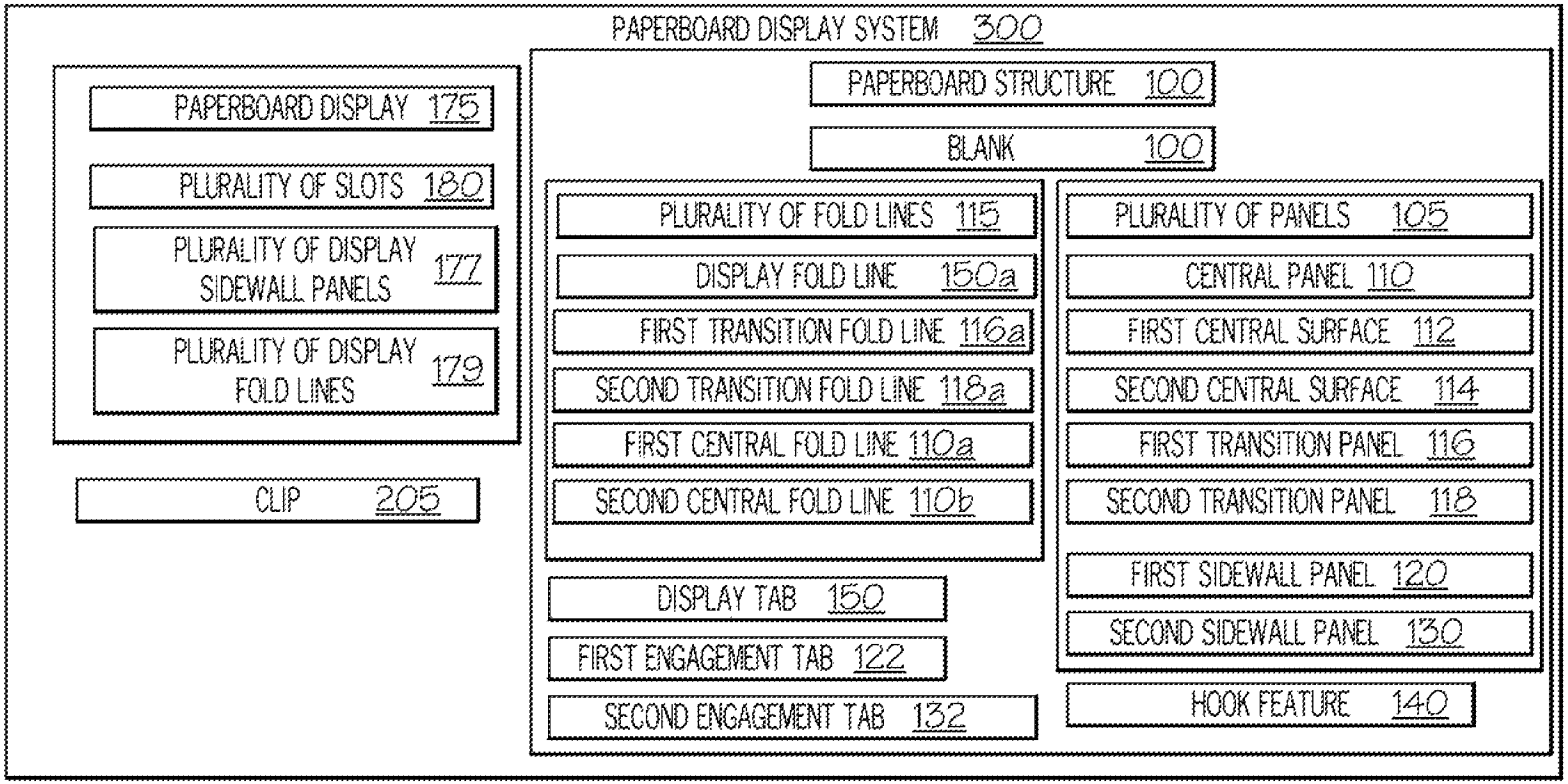
FIG. 9 is a block diagram of a cellulosic display system.

Referring to FIGS. 6, 7 and 9, in one or more examples, a cellulosic display system 300 is disclosed. In one example, the cellulosic display system 300 includes a cellulosic display 175. Cellulosic display 175 includes a plurality of display sidewall panels 177 and a plurality of display fold lines 179. At least one display panel of the plurality of display sidewall panels 177 includes a plurality of slots 180. In one example, the plurality of slots 180 are generally "T" shaped. In another example, the plurality of slots 180 are generally "I" shaped. Cellulosic display may be movable from a first configuration that is generally planar to a second configuration that is generally boxed.

Referring to FIGS. 6, 7 and 9, in one or more examples, the cellulosic display system 300 includes at least one cellulosic display structure 100 as shown and described herein. In another example, the cellulosic display system 300 includes more than one cellulosic display structure 200 such that the number of cellulosic display structures 100 aligns with the number of slots in the plurality of slots 180.

In one or more examples, the cellulosic display structure 100 includes a plurality of sidewall panels 105. The plurality of sidewall panels 105 include a central panel 110. the central panel 110 having a first central surface 112 and an opposing second central surface 114. The cellulosic display structure 200 further includes a first sidewall panel 120. The first sidewall panel 120 includes at least one hook feature 140. In one example, the cellulosic display structure 100 is engageable with at least one slot of the plurality of slots 180 on the cellulosic display 175.

Figure 8:
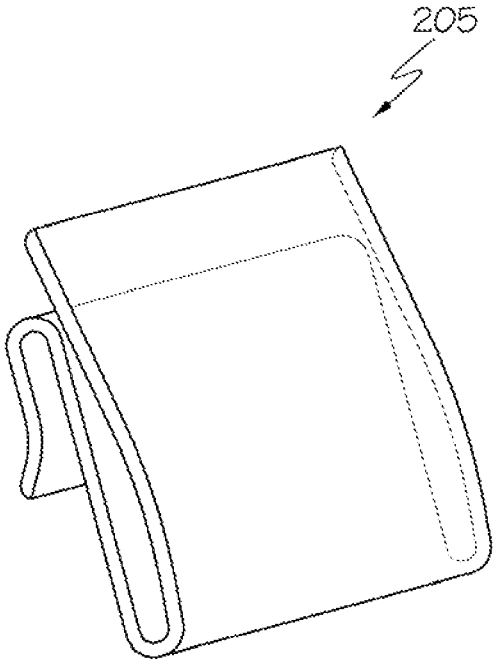
FIG. 8 is a perspective view of a clip.

Referring to FIG. 8, in one or more examples, the cellulosic display system 300 includes at least one clip 205. Clip 205 is configured to engage with the at least one cellulosic display structure 100 of the cellulosic display system 300. In one, nonlimiting example, the clip 205 is a powerwing clip. The powerwing clip, or sidekick, is one example of a clip 205 used for retail displays. Other types of clip 205 are contemplated and may be implemented with the cellulosic display system 300 based upon the type of products displayed with the cellulosic display system 300.

Although various examples of the disclosed cellulosic display structures and cellulosic display systems have been shown and described, modifications may occur to those skilled in the art upon reading the specification. The present application includes such modifications and is limited only by the scope of the claims.

What is claimed is:

1. A cellulosic display structure comprising:

a plurality of sidewall panels, the plurality of sidewall panels comprising:

a central panel;

a first sidewall panel, the first sidewall panel comprises at least one hook feature; and a first transition panel positioned between the central panel and the first sidewall panel, wherein the first transition panel is defined by a first central fold line and a first transition fold line, and wherein the first transition panel is movable between a first configuration and a second configuration and wherein the first transition panel overlaps with a portion of the central panel when the first transition panel is in the second configuration, and wherein the first sidewall panel is perpendicular to the central panel and the first transition panel when the first transition panel is in the second configuration.

2. The cellulosic display structure of claim 1, further comprising:

an adhesive disposed on the second central surface of the central panel.

3. The cellulosic display structure of claim 1, wherein the first sidewall panel comprises at least one more hook feature.

4. The cellulosic display structure of claim 1, wherein the first sidewall panel comprises a first engagement tab configured to engage with a cellulosic display.

5. The cellulosic display structure of claim 1, further comprising a display tab configured to be engaged with at least one of the plurality of sidewall panels, wherein the display tab is configured to display indicia.

6. The cellulosic display structure of claim 1, wherein the first transition panel is substantially aligned with the central panel and the first sidewall panel when the first transition panel is in the first configuration.

7. The cellulosic display structure of claim 1, further comprising:

a second sidewall panel, the second sidewall panel comprises at least one hook feature.

8. The cellulosic display structure of claim 7, wherein the second sidewall panel comprises at least one more hook feature.

9. The cellulosic display structure of claim 7, wherein the second sidewall panel comprises a second engagement tab configured to engage with a cellulosic display.

10. The cellulosic display structure of claim 7, wherein the second sidewall panel comprises a locking tab configured to fold along a locking fold line and secure the cellulosic display structure in a cellulosic display.

11. The cellulosic display structure of claim 7 being comprised of at least one of cardboard, fiberboard, paperboard, foamboard, corrugated paper, and corrugated board.

12. The cellulosic display structure of claim 7, further comprising:

a second transition panel positioned between the central panel and the second sidewall panel, wherein the second transition panel is defined by a second central fold line and a second transition fold line, and wherein the second transition panel is movable between a first configuration and a second configuration.

13. The cellulosic display structure of claim 12, wherein the second transition panel is substantially aligned with the central panel and the second sidewall panel when the second transition panel is in the first configuration.

14. The cellulosic display structure of claim 12, wherein the second transition panel overlaps with a portion of the central panel when the second transition panel is in the second configuration, and wherein the second sidewall panel is perpendicular to the central panel and the second transition panel when the second transition panel is in the second configuration.

15. The cellulosic display structure of claim 12, wherein the at least one hook feature of the first sidewall panel and the at least one hook feature of the second sidewall panel align when the first transition panel and the second transition panel are in the second configuration.

16. The cellulosic display structure of claim 1 wherein the central panel comprises a first central surface and an opposing second surface.

17. A cellulosic display system, the cellulosic display system comprising:

a cellulosic display having a plurality of slots; and at least one cellulosic display structure, the cellulosic display structure comprising:

a plurality of sidewall panels, the plurality of sidewall panels comprising:

a central panel, the central panel having a first central surface and an opposing second central surface;

a first sidewall panel, the first sidewall panel comprises at least one hook feature, wherein the cellulosic display structure is engageable with at least one slot of the plurality of slots; and a first transition panel positioned between the central panel and the first sidewall panel, wherein the first transition panel is defined by a first central fold line and a first transition fold line, and wherein the first transition panel is movable between a first configuration and a second configuration and wherein the first transition panel overlaps with a portion of the central panel when the first transition panel is in the second configuration, and wherein the first sidewall panel is perpendicular to the central panel and the first transition panel when the first transition panel is in the second configuration.

18. A cellulosic display system, the cellulosic display system comprising:

a cellulosic display having a plurality of slots; and at least one cellulosic display structure, the cellulosic display structure comprising:

a plurality of sidewall panels, the plurality of sidewall panels comprising:

a central panel;

a first sidewall panel, the first sidewall panel comprises at least one hook feature engageable with at least one of the plurality of slots;

a first transition panel positioned between the central panel and the first sidewall panel, wherein the first transition panel is defined by a first central fold line and a first transition fold line, and wherein the first transition panel is movable between a first configuration and a second configuration and wherein the first transition panel overlaps with a portion of the central panel when the first transition panel is in the second configuration, and wherein the first sidewall panel is perpendicular to the central panel and the first transition panel when the first transition panel is in the second configuration; and a second sidewall panel, the second sidewall panel comprises at least one hook feature engageable with at least another of the plurality of slots.

* * * * *